US005159942A

United States Patent [19]

Brinkley et al.

[11] Patent Number: 5,159,942

[45] Date of Patent: Nov. 3, 1992

[54] PROCESS FOR PROVIDING SMOKABLE MATERIAL FOR A CIGARETTE

[75] Inventors: Paul A. Brinkley; Thomas W. Brown, both of Winston-Salem; Jack G. Flinchum, Jr., Pfafftown; Thomas A. Perfetti, Winston-Salem; James S. Thomasson, Statesville; Harvey J. Young, Advance, all of N.C.

[73] Assignee: R. J. Reynolds Tobacco Company, Winston-Salem, N.C.

[21] Appl. No.: 710,273

[22] Filed: Jun. 4, 1991

[51] Int. Cl.[5] ..... A24B 15/18

[52] U.S. Cl. ..... 131/298; 131/297

[58] Field of Search ..... 131/297, 298

[56] References Cited

U.S. PATENT DOCUMENTS

| | | |
|---|---|---|
| 1,016,844 | 2/1912 | Moonelis . |
| 1,068,403 | 7/1913 | Maier . |
| 1,671,259 | 5/1928 | Schloesing . |
| 3,353,541 | 11/1967 | Hind et al. . |
| 3,386,449 | 6/1968 | Hind . |
| 3,386,450 | 6/1968 | Seligman et al. . |
| 3,398,754 | 8/1968 | Tughan . |
| 3,409,026 | 11/1968 | Hind et al. . |
| 3,411,514 | 11/1968 | Hind et al. . |
| 3,411,515 | 11/1968 | Hind et al. . |
| 3,420,241 | 1/1969 | Hind et al. . |
| 3,428,053 | 2/1969 | Schoenbaum et al. . |
| 3,435,829 | 4/1969 | Hind et al. . |
| 3,464,422 | 9/1969 | Light et al. . |
| 3,483,874 | 12/1969 | Hind . |
| 3,540,455 | 11/1970 | Fiore et al. . |
| 3,616,801 | 11/1971 | Hind . |
| 3,742,962 | 7/1973 | Brochot . |
| 3,821,960 | 7/1974 | Egri . |
| 3,847,164 | 11/1974 | Mattina et al. . |
| 4,182,349 | 1/1980 | Selke . |
| 4,270,552 | 6/1981 | Jenkins et al. . |
| 4,337,783 | 7/1982 | Hopper et al. . |
| 4,421,126 | 12/1983 | Gellatly . |
| 4,628,947 | 12/1986 | Driscoll et al. . |
| 4,674,519 | 6/1987 | Keritsis et al. . |
| 4,744,375 | 5/1988 | Denier et al. . |
| 4,962,774 | 10/1990 | Thomasson et al. . |
| 4,972,854 | 11/1990 | Kiernan et al. . |
| 4,987,906 | 1/1991 | Young et al. . |
| 5,018,540 | 5/1991 | Grubbs et al. . |

OTHER PUBLICATIONS

Silberstein, TJI, vol. 1, pp. 26-29 (1985).

Tobacco Encyclopedia, Edited by Voges, pp. 389-390, TJI (1984).

*Primary Examiner*—Theatrice Brown

*Assistant Examiner*—J. Doyle

*Attorney, Agent, or Firm*—August J. Borschke

[57] ABSTRACT

Reconstituted tobacco material is provided by extracting tobacco material using water to provide an insoluble portion and an aqueous extract. The insoluble portion is formed into a sheet-like shape. The aqueous extract is blended with a further tobacco extract which is provided by treating Burley tobacco strip with ammonia and steam. The aqueous tobacco extract and further tobacco extract optionally can be heat treated, contacted with a water soluble phosphate salt, and/or contacted with levulinic acid. The aqueous extract and further tobacco extract are combined with the insoluble portion, resulting in a reconstituted tobacco material. The reconstituted tobacco material is blended with other tobacco materials and employed as cut filler in cigarette manufacture.

31 Claims, 5 Drawing Sheets

PROCESS FOR PROVIDING SMOKABLE MATERIAL FOR A CIGARETTE

BACKGROUND OF THE INVENTION

The present invention relates to cigarettes, and in particular to those cigarettes having a reconstituted tobacco material incorporated therein.

Cigarettes are popular smoking articles which have a substantially cylindrical rod shaped structure and include a charge of tobacco (i.e., in cut filler form) surrounded by a wrapper, such as paper, thereby forming a tobacco rod. It has become desirable to manufacture a cigarette having a cylindrical filter element aligned in an end-to-end relationship with the tobacco rod. Typically, a filter element is manufactured from fibrous materials (e.g., cellulose acetate tow) circumscribed by plug wrap, and is attached to the tobacco rod using a circumscribing tipping material. See, Baker, *Prog. Ener. Combust. Sci.*, Vol. 7, pp. 135–153 (1981).

Typical cigarettes include blends of various tobaccos, such as flue-cured, Burley, Maryland and Oriental tobaccos. Cigarette blends also can include certain amounts of processed and reconstituted tobacco materials. Reconstituted tobacco materials often are manufactured from tobacco stems, dust and scrap using papermaking processes. See, *Tobacco Encyclopedia*, edit. by Voges, pp. 389–390, TJI (1984), and U.S. Pat. Nos. 4,962,774 to Thomasson et al and 4,987,906 to Young et al.

It would be desirable to provide a process for manufacturing a reconstituted tobacco material useful as a smokable material for the manufacture of cigarettes.

SUMMARY OF THE INVENTION

The present invention relates to a process for providing a reconstituted tobacco material. The process involves extracting components from a tobacco material using a solvent having an aqueous character. As such, an aqueous tobacco extract (i.e., tobacco extractables within the solvent) and a water insoluble tobacco portion (i.e., the portion not extracted by the solvent) are provided. At least a portion of the aqueous extract is separated from the insoluble portion. The insoluble portion then is formed into a desired shape (e.g., a sheet-like shape); and the aqueous tobacco extract is contacted with a further tobacco extract, and optionally, an organic acid. A preferred further tobacco extract is a tobacco extract provided by treating a tobacco material under extraction conditions with a basic material, such as ammonia. Normally, the aqueous tobacco extract is contacted with the further tobacco extract, optionally concentrated to a desired extract concentration in solvent, and then contacted with the optional organic acid. However, the optional organic acid and further tobacco extract can be contacted with one another and then contacted (e.g., blended) with the aqueous tobacco extract. The resulting aqueous tobacco extract then is applied to the formed insoluble portion; and the resulting tobacco composition is dried to the desired moisture level, thereby providing a reconstituted tobacco material.

In another aspect of the present invention, the aqueous tobacco extract is concentrated to a desired extract concentration in solvent (e.g., to a dissolved solids level of about 15 to about 50 weight percent) and subjected to heat treatment in a pressure controlled environment as set forth in U.S. patent application Ser. Nos. 452,175, filed Dec. 18, 1989 now U.S. Pat. No. 5,060,669 and 536,250, filed Jun. 11, 1990; which are incorporated herein by reference. The heat treated aqueous tobacco extract then is contacted with the further tobacco extract and optional organic acid. The resulting aqueous tobacco extract then is applied to the formed insoluble portion; and the resulting tobacco composition is dried to the desired moisture level, thereby providing a reconstituted tobacco material.

In yet another aspect, the aqueous tobacco extract and further tobacco extract are contacted with one another, concentrated to a desired extract concentration in solvent (e.g., to a dissolved solids level of about 15 to about 50 weight percent) and subjected to heat treatment in a pressure controlled environment as set forth in U.S. patent application Ser. No. 452,175, filed Dec. 18, 1989, now U.S. Pat. No. 5,060,669 and 536,250, filed Jun. 11, 1990. The heat treated aqueous tobacco extract then can be contacted with optional the organic acid. The resulting aqueous tobacco extract then is applied to the formed insoluble portion; and the resulting tobacco composition is dried to the desired moisture level, thereby providing a reconstituted tobacco material.

In yet another aspect, the aqueous extract is contacted with the further tobacco extract, and the resulting extract is contacted with a water soluble phosphate salt (e.g., diammonium hydrogen orthophosphate). The resulting aqueous tobacco extract then is applied to the formed insoluble portion; and the resulting tobacco composition is dried to the desired moisture level, thereby providing a reconstituted tobacco material.

The resulting reconstituted tobacco material can be employed using techniques known in the art. For example, the reconstituted tobacco material can be provided in a sheet-like form having a thickness approximating that of tobacco leaf lamina; and the material can be blended with other tobacco materials, cut or shredded to the desired size, and employed as smokable cut filler for the manufacture of cigarettes.

DETAILED DESCRIPTION OF THE PREFERRED EMBODIMENTS

Figure 1:
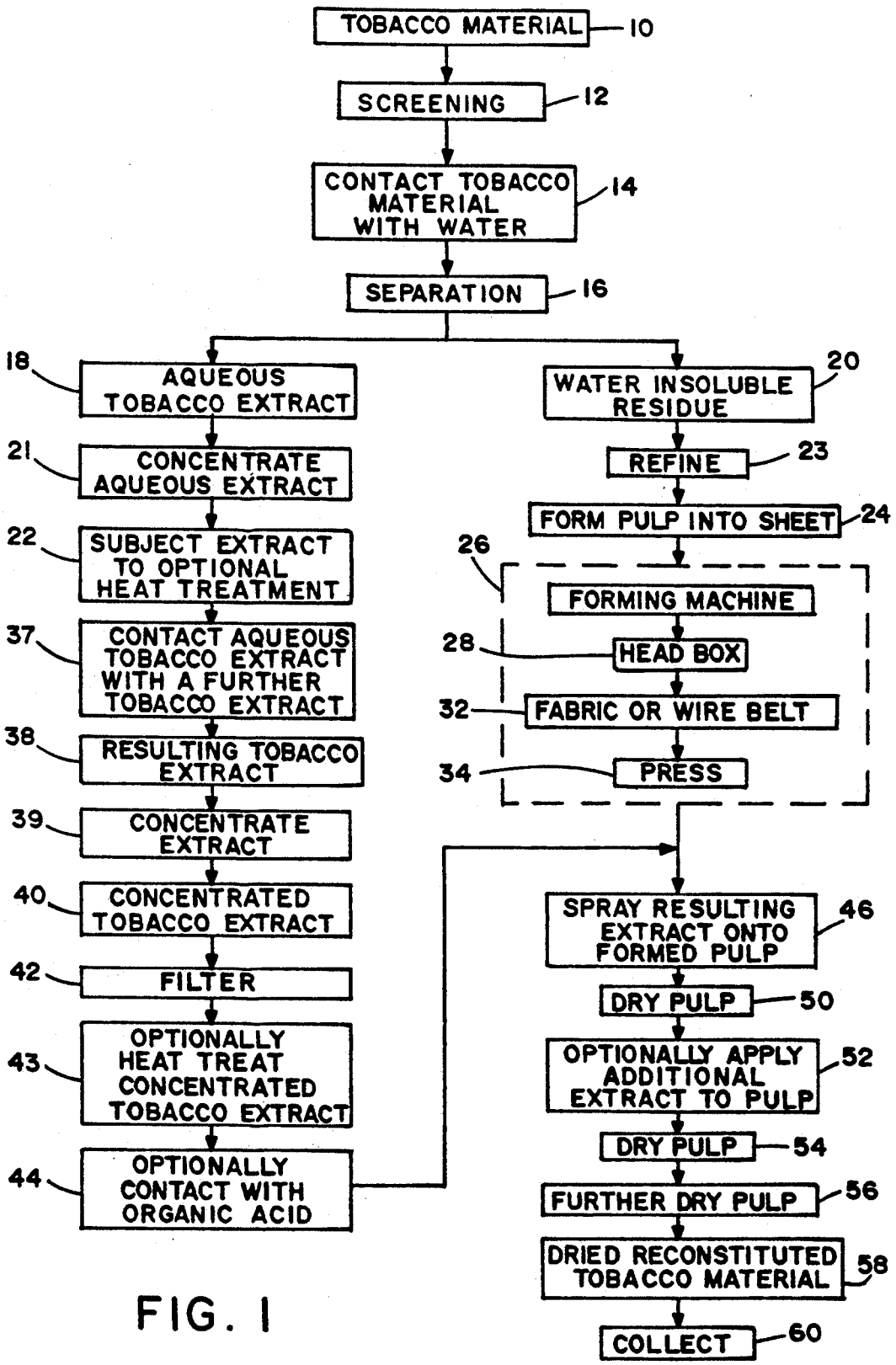
FIGS. 1 through 3 are schematic diagrams of steps representative of embodiments of the present invention.

Referring to FIG. 1, tobacco material 10 can have the form of stem, dust, scrap, cut filler, strip, or the like. One or more of the aforementioned exemplary tobacco materials can be provided separately, or as blends thereof. The tobacco material can be screened 12 or otherwise processed to remove impurities (e.g., sand) therefrom. Techniques for removing particular impurities from particular tobacco materials can vary, depending upon factors such as the form of the tobacco material being processed; and such techniques will be apparent to the skilled artisan.

The tobacco material is contacted with water 14 under conditions such that water soluble components of the tobacco are extracted by the water. The mixture, which is an aqueous tobacco slurry, is subjected to separation conditions 16 so as to provide extracted tobacco components in an aqueous phase 18 and a water insoluble residue 20. The manner of separation of the liquid extract from the insoluble residue can vary. Typical separation techniques involve centrifugation, the use of one or more passes of the mixture through a disc press or screw press, or the like. If desired, the liquid extract can be filtered or centrifuged to provide a liquid extract essentially absent of insoluble materials and precipitates. The liquid extract preferably is concentrated 21 using evaporation techniques, or the like. If desired, the resulting concentrated extract can be subjected to heat treatment 22 (e.g., subjected to a temperature of about 180° F. to about 250° F. for about 10 minutes to about 90 minutes). Normally, such optional heat treatment is provided under ambient pressure or slight vacuum conditions.

The water insoluble residue 20 can be refined 23 using papermaking type refiners such as disc refiners, conical refiners, or the like. As such, the residue is subjected to a size reduction step and thereby is formed into pulp 24 for use in the subsequent manufacture of a reconstituted tobacco product. The pulp 24 is transferred to a forming machine 26 consisting of a headbox 28, a continuous fabric or wire mesh belt 32, and a series of presses 34. Such a forming machine is common in the papermaking industry. Such a forming machine, the selection of the continuous belt and the operation of the forming machine will be apparent to the skilled artisan. The pulp is laid onto the fabric or wire mesh belt 32 (e.g., after being laid onto a forming cylinder), and is thereby formed into a sheet-like shape. Excess water is released from the pulp using the series of presses or press rolls 34 after initial dewatering on the fabric or wire belt. Preferably, forming water removed from the pulp through the fabric or wire belt is recycled back to the headbox to provide a desirably diluted pulp which is in turn laid onto the belt.

Meanwhile, the liquid extract 18 (e.g., the concentrated aqueous extract) is contacted, or otherwise mixed, combined or blended, with a further tobacco extract 37 to provide a resulting liquid extract 38. For example, two liquid tobacco extracts can be metered continuously into a tank or other reservoir. Methods for providing such a further tobacco extract are described in greater detail hereinafter with reference to FIG. 4. The resulting liquid extract 38 most preferably is concentrated 39 by heating, or other such method, to evaporate a desired amount of the water. For example, the extract can be passed over steam-filled tubes or through steam jacketed tubes. If desired, the liquid extract 18 can be concentrated using a forced circulation evaporator, or the like, and then contacted with a predetermined amount of the further tobacco extract 37, which also has been concentrated, so that the resulting extract does not need to be concentrated any further. Optionally, the resulting concentrated extract 40 is filtered 42 using a screening technique, or the like, in order to remove suspended solid materials from the liquid extract. Such a liquid extract normally exhibits a pH of about 5 to about 7.5.

Optionally, the concentrated liquid extract 40 can be subjected to heat treatment 43 (e.g., heat treatment in a pressure controlled environment) as described in U.S. patent application Ser. Nos. 452,175, filed Dec. 18, 1989, now U.S. Pat. No. 5,060,669 and 536,250, filed Jun. 11, 1990. Such heat treatment preferably is provided after the liquid extract 18 and the further extract 37 have been contacted, and most preferably after the contacted extracts have been concentrated 38 (as shown in FIG. 1). Alternatively, the liquid extract 18 can be subjected to the aforementioned heat treatment, preferably after that liquid extract has been concentrated, and then contacted with the further tobacco extract 37. If desired, the further tobacco extract 37 can be subjected to the aforementioned heat treatment, and then contacted with the liquid extract 18. Additives (e.g., levulinic acid, fructose, asparagine, glutamine, furaneol, maltol, 2,3-pentanedione or 2,3-butanedione) can be contacted with such tobacco extracts before the tobacco extracts are subjected to such heat treatment.

The liquid extract optionally is contacted with an organic acid 44. For example, the organic acid is charged neat into the liquid extract. The organic acid can be contacted with the liquid extract in a batch-wise manner, or introduced into a static mixer or "scrubber," or the like, so as to continuously contact the liquid extract at a controlled rate. The liquid extract and organic acid are mixed or otherwise agitated to obtain a homogeneous mixture. A preferred organic acid is levulinic acid.

The resulting liquid extract then is applied to the pulp 24 on the fabric or wire mesh belt 32 using a spraying technique 46, or a similar application means (e.g., size press techniques). For example, liquid tobacco extracts which are metered continuously into a reservoir are sprayed therefrom onto the pulp. The selection of spraying apparatus will be apparent to the skilled artisan.

The sheet-like pulp having the liquid extract applied thereto is passed through a dryer 50 such as an apron dryer, or the like. If desired, a further amount of the liquid extract 52 can be applied to one or both sides of the dried pulp 54, and the resulting reconstituted tobacco material can be passed through another dryer 56. Alternatively, the resulting reconstituted tobacco material can be passed through the dryer or dryers more than one time. The dried reconstituted tobacco material 58 which results can be collected 60 and is processed further as required for use as smokable filler for cigarette manufacture.

Figure 2:
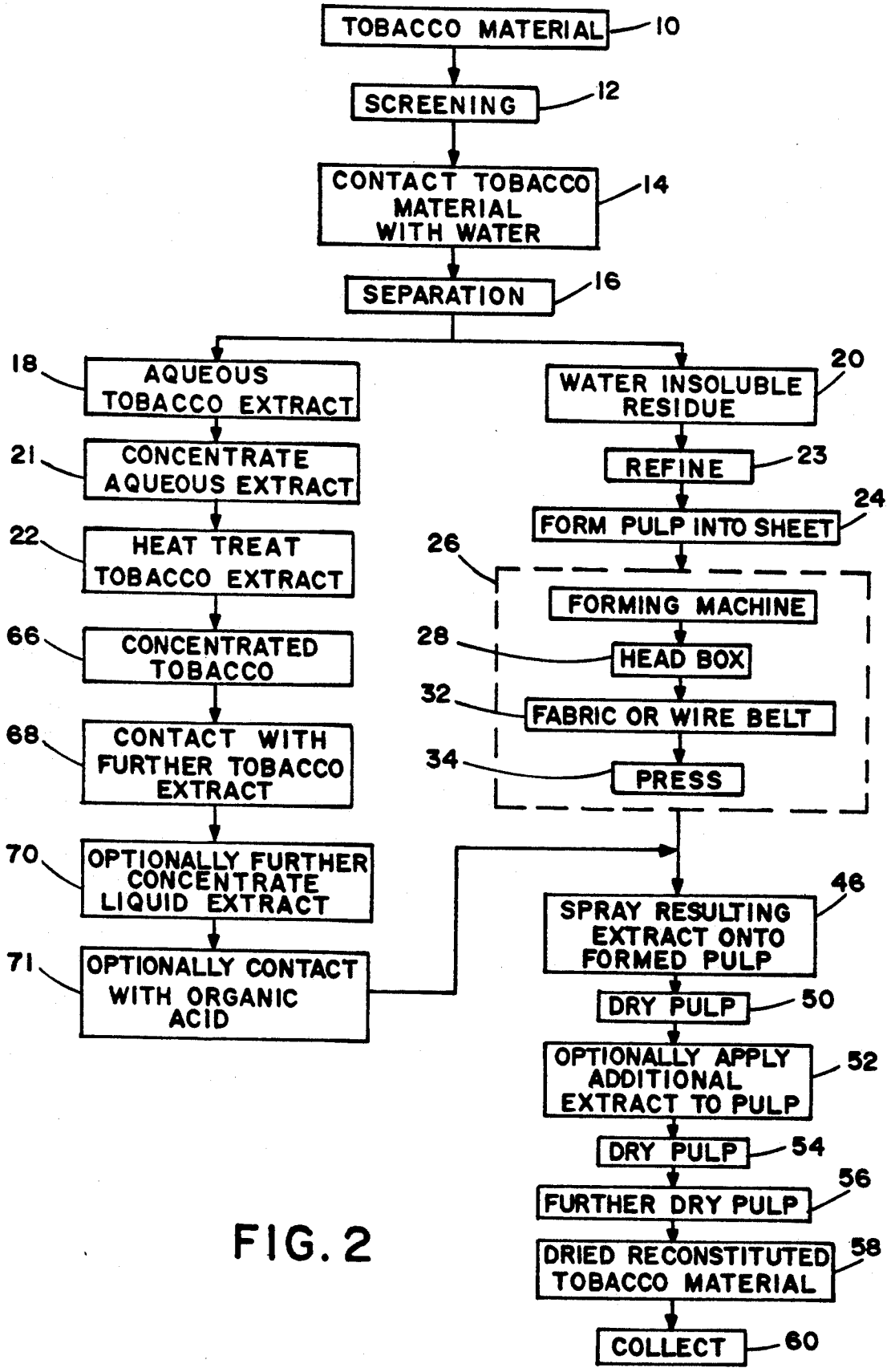

Referring to FIG. 2, tobacco material 10 is processed generally as described with reference to FIG. 1, except that the liquid extract 18 is subjected to heat treatment 22, preferably after the liquid extract is concentrated 21. The preferred heat treatment is carried out in a pressure controlled environment. The resulting concentrated extract 66 then is contacted with the further tobacco extract 68, and optionally concentrated further 70; and then optionally contacted with an organic acid 71 (as shown in FIG. 2). Alternatively, the concentrated extract 66 can be (i) contacted with organic acid and then contacted with the further tobacco extract, (ii) contacted with organic acid and further tobacco extract from separate feed sources but simultaneously, or (iii) contacted with a mixture of organic acid and the further tobacco extract.

Figure 3:
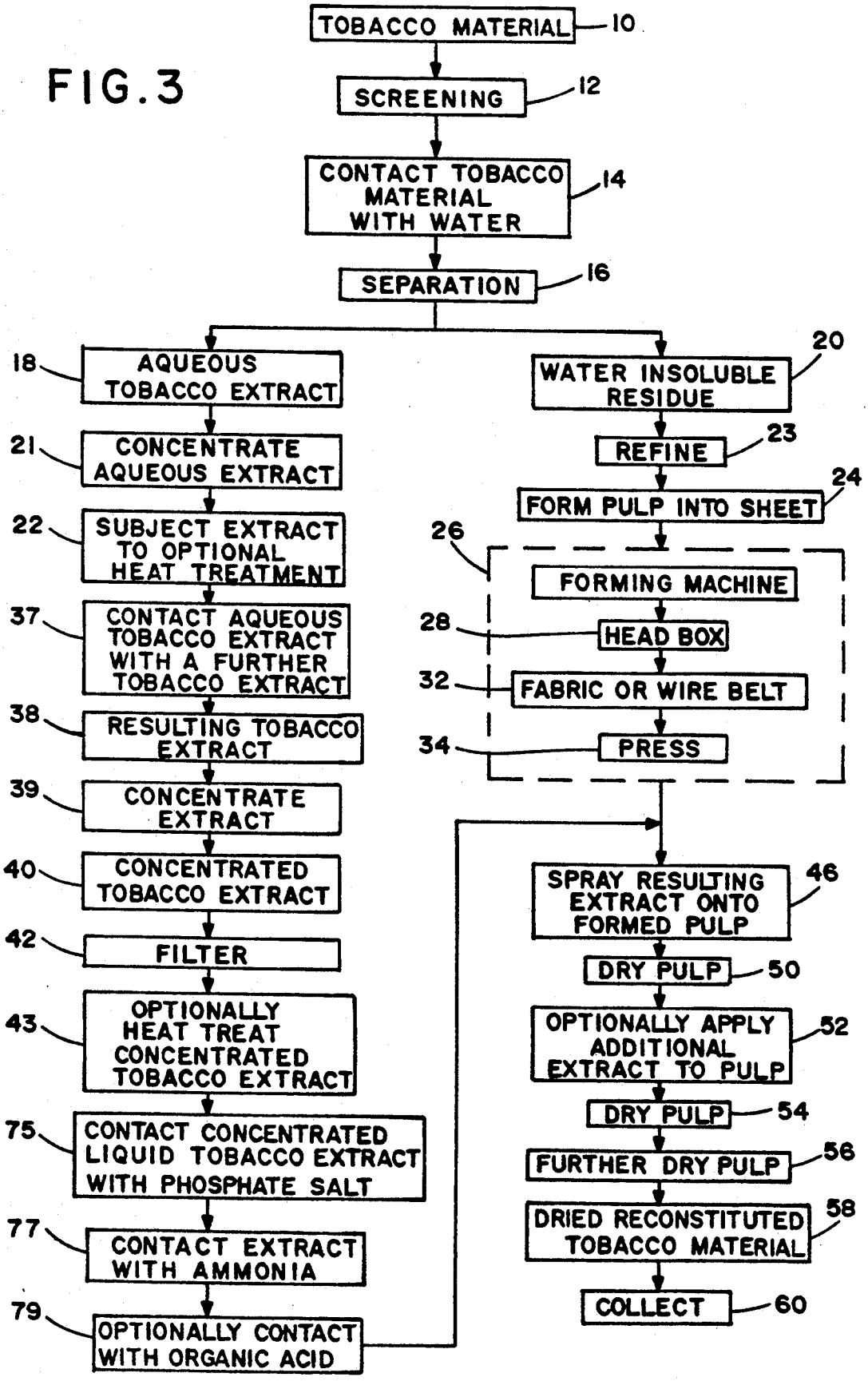

Referring to FIG. 3, tobacco material 10 is processed generally as described with reference to FIG. 1, except that the concentrated extract 40, after being subjected to the optional heat treatment 43, is contacted with a water soluble phosphate salt 75 and ammonia 77 (or other agent capable of increasing the pH of that liquid extract); and then optionally contacted with an organic acid 79. If desired, the concentrated extract 40 can be contacted with the phosphate salt and then contacted with ammonia; or the concentrated extract can be contacted with ammonia and then contacted with the phosphate salt.

Tobacco materials used in carrying out the process of the present invention can vary. The tobacco materials which are reconstituted according to the present invention are of a form such that, under extraction conditions, a portion thereof is soluble in (i.e., extracted by) the extraction solvent; and a portion thereof is insoluble in (i.e., not extracted by) the extraction solvent. Examples of suitable types of tobaccos include flue-cured, Burley and Maryland tobaccos, although other types of tobacco can be employed. The tobacco material generally has been aged, and can be in the form of laminae and/or stem, or can be in a processed form. Typically, the tobacco material employed is a waste material and/or processing by-product such as fines, dust, scrap or stem. All or part of the tobacco material can be previously cased and/or top dressed. The aforementioned materials can be processed separately, or as blends thereof.

The tobacco material to be reconstituted is contacted with a solvent having an aqueous character. Such a solvent consists primarily of water, normally greater than 90 weight percent water, and can be essentially pure water in certain circumstances. Essentially pure water includes deionized water, distilled water and tap water. However, the solvent can include water having substances such as pH buffers or the like dissolved therein. The solvent also can be a co-solvent mixture of water and minor amounts of one or more solvents which are miscible therewith. An example of such a co-solvent mixture is a solvent consisting of 95 parts water and 5 parts ethanol.

The amount of tobacco material which is contacted with the solvent can vary. Typically, the weight of solvent relative to the tobacco material is greater than 4:1, oftentimes greater than 5:1, and frequently greater than about 10:1. The amount of solvent relative to tobacco material depends upon factors such as the type of solvent, the temperature at which the extraction is performed, the type or form of tobacco which is extracted, the manner in which contact of the tobacco material and solvent is conducted, and other such factors. The manner of contacting the tobacco material and solvent is not particularly critical.

The conditions under which the extraction is performed can vary. Typical temperatures range from about 50° F. to about 175° F. The solvent/tobacco material mixture can be agitated (e.g., stirred, shaken, or otherwise mixed) in order to increase the rate at which extraction occurs. Typically, adequate extraction of components occurs in less than about 60 minutes, and oftentimes in less than about 30 minutes. As such, an aqueous tobacco slurry is provided.

The solvent and tobacco components extracted thereby are separated from the insoluble residue. When the solvent has an aqueous character, the insoluble residue includes components of the biopolymer matrix of the tobacco material and other tobacco components which are not extracted by that solvent. The manner of separation of the components of the slurry can vary; however, it is convenient to employ conventional separation means such as filtration, centrifugation, pressing, or the like. Generally, the separation of the components of the slurry is performed while the slurry is maintained at above ambient temperature. It is desirable to provide a solution of solvent and tobacco extract having a very low level of suspended solids, while removing the greatest amount of solvent from the insoluble residue as is possible. Typically, the separation of the components of the aqueous tobacco slurry is performed in order to provide (i) a damp pulp having a low level of residual solubles; and (ii) an aqueous extract including tobacco extract components.

The pulp (i.e., the insoluble tobacco residue) is refined and formed into a sheet, or other desired shape. Typically, the pulp is laid onto a fabric or wire mesh belt using known papermaking techniques and equipment. Oftentimes, damp pulp is contacted with further aqueous liquid to provide a slurry of sufficiently low solids content so as to have the pulp in a slurry form which can be readily formed as a sheet on a fabric, screen or wire mesh belt. The formed pulp then is treated to remove excess water therefrom by passing the pulp through a series of presses, dryers, vacuum boxes, or the like. Techniques for removing excess water from formed pulp will be apparent to the skilled artisan. Preferably, the pulp includes extracted pieces of tobacco stem as a component thereof.

If desired, the pulp can be contacted with additives and/or treated so as to alter its chemical composition. The pulp can be combined with wood pulp fibers, flax fibers, calcium carbonate particles, carbonaceous particles, agglomerated calcium carbonate particles, calcium sulfate fibers, or the like, in a manner set forth in U.S. patent application Ser. No. 416,332, filed Sep. 29, 1989, now U.S. Pat. No. 5,056,537. Usually, the amount of additive combined with the pulp does not exceed 15 percent, and frequently does not exceed about 10 percent, of the dry weight of the pulp. Usually, an additive such as would pulp or flax fibers is added to the tobacco pulp just prior to the time that the pulp is refined. The pulp also can be subjected to enzyme treatment as set for in U.S. Pat. No. 4,887,618 to Bernasek et al, heat treated, or otherwise processed to change the chemical composition of that material.

The liquid extract is provided at a desired soluble solids level, and normally is concentrated to achieve such a soluble solids level. Typically, the aqueous phase is evaporated such that the concentrated extract includes more than about 15 percent tobacco extract components, preferably about 20 to about 50 tobacco extract components, more preferably about 25 to about 40 percent tobacco extract components, based on the weight of the tobacco extract components and solvent. Techniques for concentrating liquid extracts will be apparent to the skilled artisan. For example, the liquid extract can be subjected to elevated temperatures and a slight vacuum. The liquid also can be subjected to heat treatment under essentially ambient conditions of pressure. For example, the liquid extract can be subjected to a temperature of about 180° F. to about 250° F., preferably about 190° F. to about 220° F., for about 10 minutes to about 90 minutes. If desired, the liquid extract can be spray dried, or otherwise processed to remove aqueous liquid therefrom and provide a tobacco extract in low solvent form, and then recombined with water to provide a liquid tobacco extract of a desired concentration.

The amount of tobacco extract and further tobacco extract which are contacted with one another can vary, depending upon factors such as the desired flavor characteristics of the ultimate reconstituted tobacco material. Normally, the amount of tobacco extract relative to the amount of further tobacco extract contacted therewith is greater than about 4:1, and is preferably about 6:1 to about 10:1, on a dry weight basis.

If desired, certain other components can be incorporated into the concentrated liquid extract, preferably after that extract is contacted with the organic acid and/or organic acid salt. For example, compounds such as urea, potassium carbonate, sodium carbonate, propylene glycol, glycerine, trimethylene glycol, potassium sorbate, sugars (e.g., high fructose corn syrup), cocoa, licorice, carbon particles, and other casing, top dressing and particulate components can be incorporated into the liquid tobacco extract.

The liquid extract can be contacted with a water soluble phosphate salt (e.g., an aqueous solution of diammonium hydrogen orthophosphate). Other water soluble phosphate salts include ammonium dihydrogen orthophosphate, potassium dihydrogen phosphate, tripotassium phosphate, potassium hydrogen phosphate and sodium dihydrogen phosphate. See, U.S. Pat. No. 4,987,906 to Young et al and U.S. patent application Ser. No. 647,329, filed Jan. 28, 1991, which are incorporated herein by reference. The manner in which the liquid extract is contacted with the phosphate salt can vary. The phosphate salt can be charged into the liquid extract, added over time to the liquid extract, or added continuously to a feedline carrying the liquid extract. The liquid extract also is contacted with ammonia or other suitable agent capable of providing a desirably high pH to the liquid extract. Typically, the pH of the liquid extract is provided at about 6 to about 8. For example, anhydrous, gaseous ammonia can be introduced into a static mixer, a "scrubber," or the like, so as to contact the liquid extract at a controlled rate. If desired, an organic acid (e.g., levulinic acid) can be added to the liquid extract after the phosphate salt has been contacted with that liquid extract.

The aqueous tobacco extract then is applied to the formed pulp. For example, the aqueous tobacco extract is uniformly applied to the pulp in a sheet-like form using a series of spray nozzles, a series of sizing rollers, or other such means. However, the manner of applying the aqueous extract is not particularly critical. Although not particularly critical, the moisture content of the pulp just prior to the time that the aqueous tobacco extract is applied thereto normally ranges from about 30 to about 80 percent, based on the weight of the pulp and moisture; and a formed pulp having a sheet-like shape is such that the dry weight thereof is about 3 grams to about 5 grams per square foot. The formed pulp having the aqueous tobacco extract applied thereto is dried to remove moisture therefrom using tunnel-type dryers, or the like. One or more applications of the aqueous extract can be provided to the formed pulp. As such, it is preferable that the mixture or blend of two or more tobacco extracts are fairly uniformly distributed throughout the pulp. The amount of tobacco extract applied to the pulp can vary. Typically, about 0.5 to about 1.5, preferably about 0.75 to about 1.25 parts of tobacco extract is applied to the pulp, based on the weight of the extract separated from the pulp during the extraction of the starting tobacco material. Normally, the extract is applied to the pulp in liquid form as an aqueous extract having a soluble solids content of about 20 to about 35 weight percent, and preferably about 25 to about 30 weight percent. The resulting reconstituted tobacco material is dried to a moisture content of about 10 to about 15 weight percent, preferably to a moisture content of about 12 to about 13 weight percent.

When phosphate salts (e.g., diammonium hydrogen orthophosphate) are incorporated into the reconstituted tobacco material, that reconstituted tobacco material normally exhibits a phosphate content of about 1 to about 2.5 percent, frequently about 1.2 to about 2.0 percent, on a dry weight basis.

The organic acid which is contacted with or otherwise incorporated into the reconstituted tobacco material can vary. The preferred organic acid includes levulinic acid. Other acids include citric acid, malic acid, acetic acid, propionic acid, tartaric acid, and the like. Further organic acids are set forth in U.S. Pat. No. 4,836,224 to Lawson et al. Organic acid salts (e.g., sodium, potassium, calcium and magnesium salts of levulinic acid) also can be employed as a form of organic acid. See, U.S. patent application Ser. No. 464,806, filed Jan. 16, 1990 now U.S. Pat. No. 5,031,646, which is incorporated herein by reference. When organic acid or organic acid salts are incorporated into the reconstituted tobacco material, that reconstituted tobacco material normally exhibits a content of the anionic moiety of the organic acid of greater than about 0.5 percent, frequently greater than about 1 percent, often greater than about 5 percent and even greater than about 10 percent; but usually less than about 25 percent, on a dry weight basis. If desired, organic acids and/or organic acid salts (e.g., sorbic acid or potassium sorbate) can be applied to the finished reconstituted tobacco material as a top dressing component.

Figure 4:
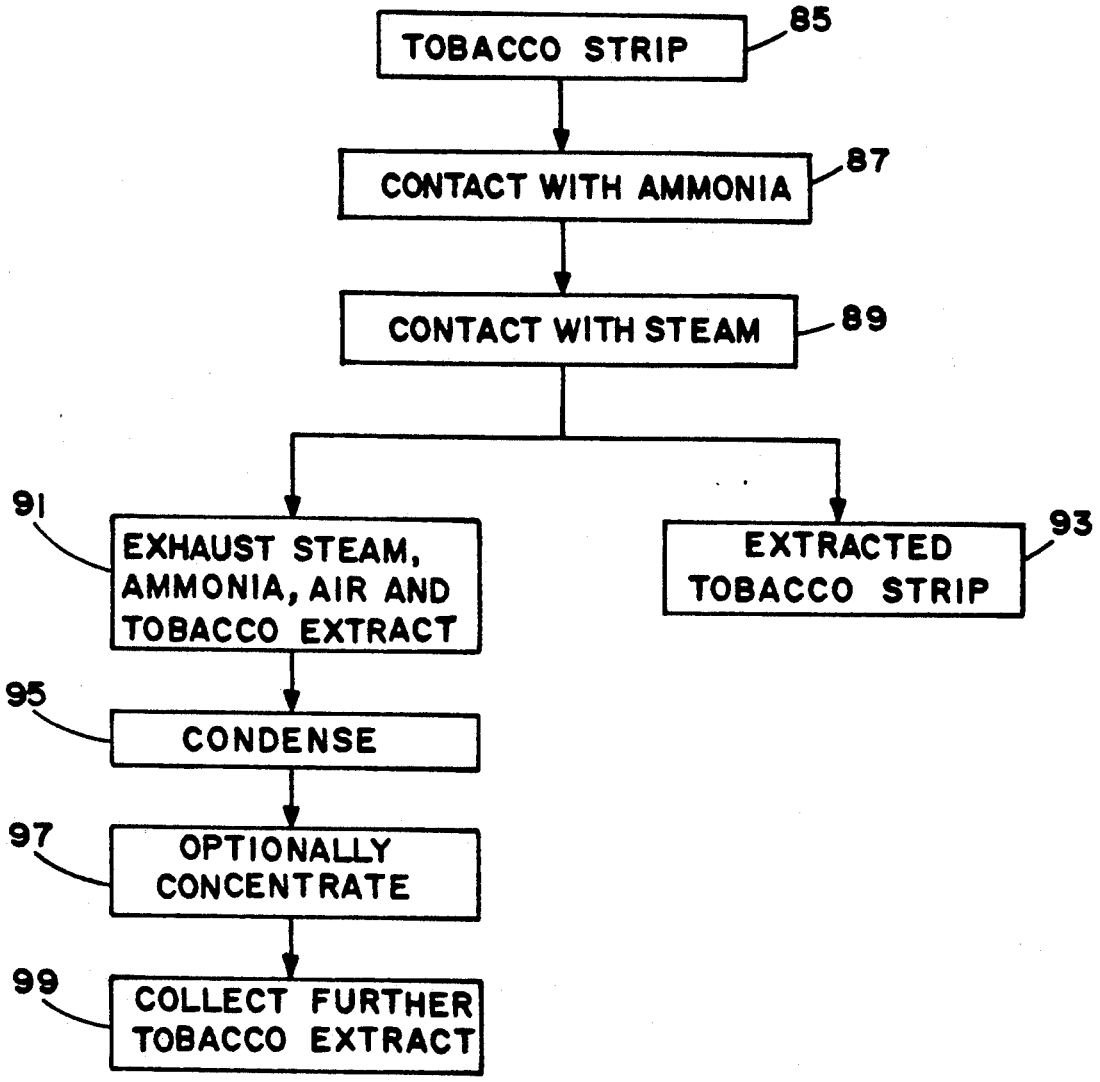
FIG. 4 is a schematic diagram of representative steps of a portion of an embodiment of the present invention.

Referring to FIG. 4, there are described steps for providing the previously described further tobacco extract. Tobacco strip 85, or tobacco material in any other suitable form, is contacted with ammonia 87 and steam 89. For example, flue-cured tobacco strip can be introduced into a treatment drum and contacted with ammonium hydroxide at ambient temperatures at a concentration of about 0.1 to about 0.5 weight part ammonium hydroxide per weight part of tobacco strip; and each weight part of tobacco strip then is contacted with about 10 to about 30 weight parts steam at about 220° F. to about 280° F. As another example, tobacco strip is contacted with gaseous ammonia or aqueous ammonium hydroxide in a suitable treatment drum, and transferred through an air lock to a second treatment or stripping drum where the tobacco material is contacted with steam. As yet another example, Burley tobacco strip can be introduced into a treatment zone and contacted simultaneously with anhydrous ammonia and steam in a countercurrent manner. Treatment drums or zones will be apparent to the skilled artisan, and such drums or zones are equipped with suitable conveyor means, air locks, insulation, etc. Steam, ammonia, air and a tobacco extract is exhausted 91 from the extracted tobacco strip 93. The exhausted steam, ammonia, air and tobacco extract which is separated from the extracted tobacco strip then is condensed 95 in a continuous manner using a scrubber or condenser to provide a liquid extract; normally including about 0.5 to about 4 weight percent tobacco extract, about 0.03 to about 3 weight percent ammonia, and the remainder water. If desired, the condensed extract can be contacted with additives (e.g., phosphoric acid in amounts sufficient to provide ammonium phosphate salts). The condensed tobacco extract then preferably is concentrated 97 so as to evaporate water and ammonia, and provide a concentrated liquid tobacco extract 99 having a tobacco extract content of about 4 to about 8 weight percent. The manner in which the condensed tobacco extract is concentrated can involve the use of wiped film evaporation techniques, reverse osmosis techniques, or the like. During concentration, at least a portion, and in certain circumstances essentially all, of the ammonia is removed from the liquid extract. If desired, the concentrated liquid tobacco extract can be subjected to heat treatment in a pressure controlled environment as set forth in U.S. patent application Ser. Nos. 452,175, filed Dec. 18, 1989, now U.S. Pat. No. 5,060,669 and 536,250, filed Jun. 11, 1990. Alternatively, the liquid extract can be heated to about 180° F. to about 250° F. for about 10 to about 90 minutes, particularly after an additive (e.g., phosphoric acid) has been added thereto. The concentrated liquid tobacco extract can be contacted with additives, if desired (e.g., the liquid extract can be contacted with phosphoric acid, particularly if not all of the ammonia is removed therefrom during concentration.

Figure 5:
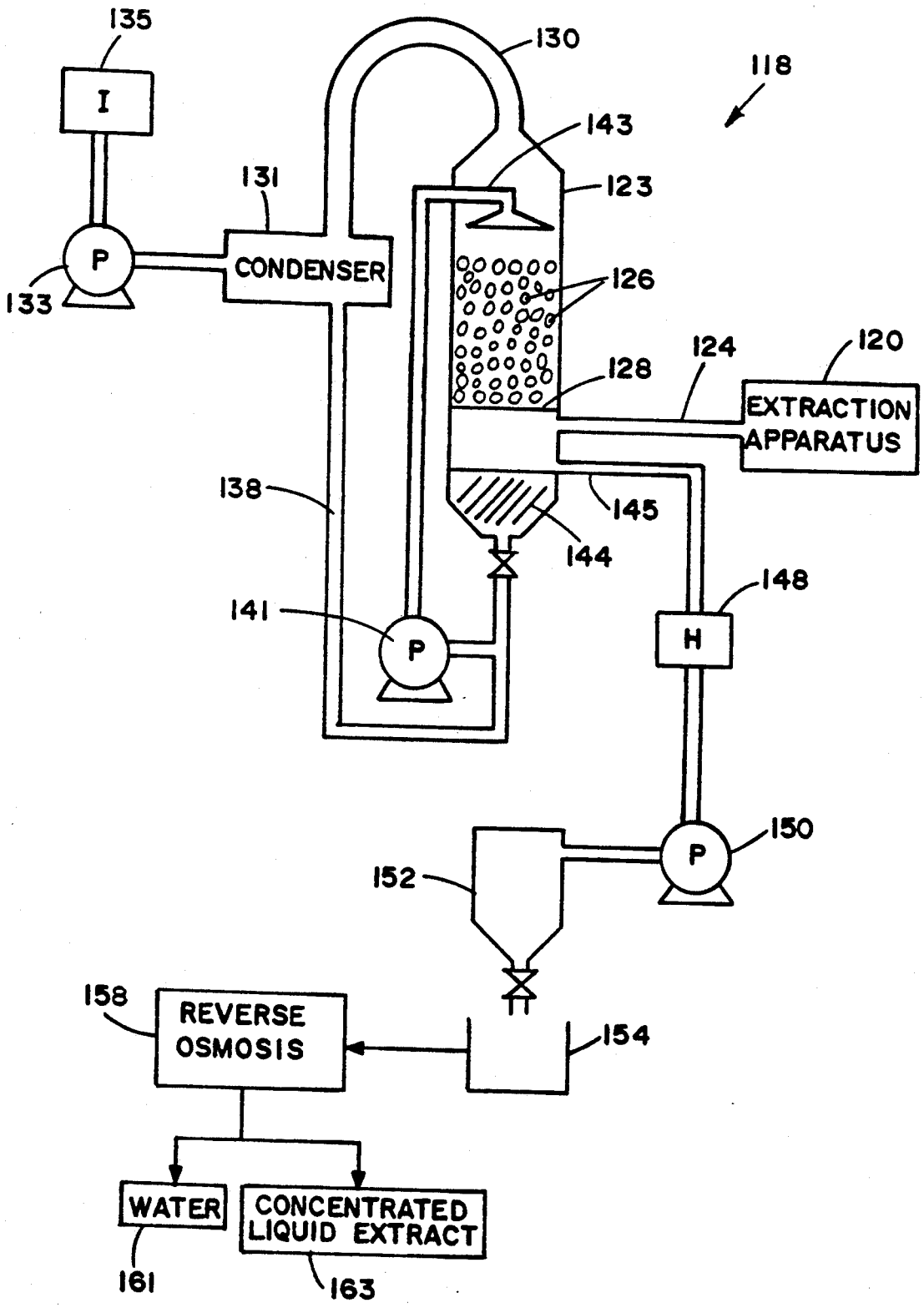
FIG. 5 is a schematic diagram of an apparatus for performing certain process steps of the present invention.

Referring to FIG. 5, there is shown an apparatus 118 for processing the previously described further extract. Steam, ammonia, air and tobacco extract exhausted from extraction apparatus or treatment zone 120 (e.g., at about 195° F.) to the bottom region of a column stripper 123 through tube 124. The column is 123 packed with a plurality of fill 126, and a screen 128 prevents the fill from falling to the bottom region of the column. Exemplary fill or packing can have a "snowflake" or "saddle" shape. See, McCabe, et al., *Unit Operations of Chemical Engineering*, (3rd Ed.) pp 707–710. Exemplary column strippers and fill are described by McCabe, et al., in *Unit Operations of Chemical Engineering*, (3rd Ed.) pp. 410, 411. Vapor exits the upper region of the column and passes through tube 130 and through a condenser 131.

An exemplary condenser is a contact condenser or a shell and tube type heat exchange condenser available as S-1000-R from American Standard, Inc. Vapor in the form of ammonia and water exits the condenser and is transferred by a backward inclined radial fan 133 or other suitable means to an incinerator 135 or other means for disposing of the ammonia. Condensed liquid (e.g., at about 100° F.) exits the condenser 131 through tube 138 and is transported via pump 141 (e.g., a centrifugal pump) to be introduced into the upper region of column 123 using a spray nozzle 143 or other suitable application means. Tobacco extract and water are collected in liquid form 144 in the bottom region of column 123; and a portion of the liquid is recirculated through the column using pump 141 while remaining liquid exits overflow port 145 and is transferred to a heat exchanger 148 (e.g., a shell and tube heat exchange unit) to cool the liquid to a temperature of preferably about 100° F. or less. Cooled liquid then is transported via pump 150 (e.g., a peristaltic hose pump) to a storage tank 152. Liquid is removed from the storage tank 152 to a portable container 154, and the liquid is in turn transferred to a reverse osmosis unit 158 or other unit for removing water from the liquid. An exemplary reverse osmosis unit is available as Sepratech from Separation Technology, Inc., equipped with reverse osmosis membranes (e.g., a Desal-3LP membrane) from Desalination Systems, Inc. As such, water is removed from the liquid and collected 161, and tobacco extract and water are also collected 163. See, *Perry's Chemical Engineers' Handbook*, (6th Ed.) edit. by Green, et al., pp. 17–22 through 17–27. Techniques such as wiped film evaporation techniques tend to cause removal of relatively high amounts of ammonia from the liquid; while techniques such as reverse osmosis techniques tend to cause significant amounts of ammonia to remain in contact with the liquid (e.g., so as to provide a liquid including about 4 to about 8 weight percent tobacco extract and about 0.1 to about 2 weight percent ammonia).

The following examples are provided in order to further illustrate the invention but should not be construed as limiting the scope thereof. Unless otherwise noted, all parts and percentages are by weight.

EXAMPLE 1

A. Manufacture of a Reconstituted Tobacco Material

A reconstituted tobacco material is provided using a papermaking process generally as described with reference to FIG. 1 using a blend of tobacco types. The blend includes about 65 parts Burley and flue-cured tobacco stem pieces and about 35 parts of tobacco laminae processing by-products.

The tobacco blend is extracted batch-wise at about 130° F. using about 10 to about 15 parts tap water for each part tobacco material. Aqueous tobacco extract is separated from the water insoluble pulp using a centrifuge. The aqueous extract so provided has a soluble solids content of about 5 percent. To that aqueous extract is added, in a batch-wise manner, a further tobacco extract which is described later in this Example. The resulting extract, which is a blend of two tobacco extracts and has a soluble solids content of about 5 percent, is concentrated to a soluble solids content of about 22 to about 28 percent using a wiped film evaporator. Then, levulinic acid is contacted with the resulting mixture in a batch-wise manner.

The pulp, which has a very low remaining water extractables content, is provided as a slurry in water at a solids content of about 2 to about 3 percent and refined in a conical refiner to a Canadian Standard Freeness of about 50 to about 200 ml. The refined slurry is diluted using recirculated forming water from the papermaking process to provide a diluted slurry having a solids content of about 0.5 to about 1 percent. The diluted slurry is formed into a sheet on a fabric belt of a papermaking apparatus, the operation of which will be apparent to the skilled artisan. The pulp is formed into a sheet having a dry basis weight of about 40 to about 50 $g/m^2$. A vacuum is pulled on the bottom of the fabric belt as is common in the papermaking industry so as to provide a damp, formed pulp having a moisture content of about 85 percent. The formed pulp is passed through a roller press to provide a damp pulp having a moisture content of about 60 to about 65 percent.

The previously described liquid extract and levulinic acid mixture is sprayed onto one side of the sheet which is formed from the insoluble pulp. The sheet then is subjected to convection heating at greater than about 300° F. to dry the sheet to a moisture content of about 55 to about 70 percent. Then, the previously described extract and levulinic acid mixture is sprayed onto the other side of the sheet. Convection drying of the sheet is continued until the moisture content of the reconstituted tobacco sheet is about 12 to about 13 percent.

The resulting reconstituted tobacco material exhibits a levulinate anion content of about 18 percent, a pulp content of about 59 percent, and a tobacco extract content of about 23 percent (on a dry weight basis). The reconstituted tobacco material has a dry weight basis weight of about 90 $g/m^2$, and a thickness approximating that of aged tobacco leaf laminae (e.g., about 400 microns). The reconstituted tobacco material is shredded into cut filler form, and blended with other smokable materials for use as a cut filler blend for cigarettes.

B. Manufacture of the Further Tobacco Extract

Burley tobacco strip is placed onto a conveyor belt and passes through a treatment zone treater which is enclosed using air locks but is maintained at atmospheric pressure. Into the enclosed treater, about ⅔ of the distance downstream from the point that the tobacco strip is introduced, is introduced gaseous, anhydrous ammonia through a sprayer in a countercurrent manner relative to the tobacco strip at a rate of about 15 to about 60 pounds of ammonia per 1000 pounds of tobacco strip. Simultaneously, the tobacco strip is exposed to steam, introduced at the extreme opposite end of the treater from the point that the tobacco strip is introduced, in an amount of about 10 to about 30 pounds per pound of tobacco strip. The steam is introduced at a temperature of about 220° F. to 280° F. The tobacco strip is contacted, on average, with the ammonia for about 10 minutes and the steam for about 30 minutes. Extracted tobacco strip then is removed from the treater. The steam, ammonia, air and tobacco volatiles, which are extracted from the tobacco strip are collected in the manner described previously with reference to FIG. 5, so as to provide an extract having a composition of about 0.5 to about 3 percent tobacco extract, about 0.03 to about 3 percent ammonia, and the remainder water. The composition so provided (e.g., condensed liquid extract) is concentrated using a thin film evaporator to evaporate off ammonia and water, and to provide a further tobacco extract in liquid form having a tobacco extract content of about 4 to about 8 percent, and a water content of about 92 to about 96 percent. Essentially all of the ammonia introduced to the extract during the extraction conditions is removed from the further liquid extract during the concentration steps.

EXAMPLE 2

A reconstituted tobacco material is provided essentially as described in Example 1; however, levulinic acid is not incorporated therein.

EXAMPLE 3

A reconstituted tobacco material is manufactured essentially as described in Example 1.

The insoluble pulp is provided from about 65 parts extracted Burley and flue-cured tobacco stem pieces and about 35 parts extracted tobacco laminae dust and processing by-products. The pulp is provided in a sheet-like shape as described in Example 1, but without applying tobacco extract thereto, and dried as described in Example 1 so as to provide a dried reconstituted tobacco sheet material having a very low water solubles content and a low moisture content of about 7 percent.

The aqueous extract is provided by extracting a blend of various types of tobaccos in dust form with water. In particular, about 1 part tobacco material are contacted with about 6 parts tap water at 135° F. in an agitated tank. The resulting mixture is centrifuged to provide an aqueous tobacco extract and a water insoluble portion. The aqueous tobacco extract is spray dried using techniques essentially as described in U.S. patent application Ser. No. 484,587, filed Feb. 23, 1990, now U.S. Pat. No. 5,031,646 to provide a tobacco extract in powder form. Into a Parr Reactor Model No. 4522 equipped with a temperature control unit available as Parr No. 4842-PID from the Parr Instrument Co. and a mechanical stirrer is charged about 28 parts spray dried extract, about 8 parts glutamine and about 64 parts of the aqueous further tobacco extract described in Example 1. The resulting mixture is stirred to provide a homogeneous solution. The pressure vessel is sealed, and the mixture is subjected to a maximum temperature of about 180° C. for about 1 hour at a pressure of about 400 psig. Then, the mixture within the pressure vessel is cooled to room temperature, the vessel is depressurized, and the resulting liquid tobacco composition is removed from the vessel. The liquid tobacco composition has a soluble solids content of about 40 percent.

The liquid tobacco composition is sprayed onto the previously described dried reconstituted tobacco sheet material. The resulting sheet is dried to a moisture content of about 12 to about 13 percent. The resulting reconstituted tobacco material has a water soluble tobacco extract content of about 40 percent.

EXAMPLE 4

A reconstituted tobacco material is manufactured essentially as described in Example 1 and with reference to FIG. 3.

Insoluble tobacco pulp is provided as described in Example 1. The aqueous tobacco extract is mixed with the further tobacco extract. The resulting extract is concentrated to about 24.1 percent tobacco extractables, and exhibits a pH of about 6.56. The aqueous extract is heated to about 130° F. The resulting aqueous extract then is contacted with a solution of about 30 parts diammonium hydrogen orthophosphate in about 70 parts water so as to add about 0.0326 lb. diammonium hydrogen orthophosphate per lb. of dissolved tobacco solids. The aqueous extract so treated exhibits a pH of about 6.84. The treated liquid extract is about 23.5 percent tobacco extract and about 76.5 percent water.

The resulting liquid extract then is sprayed onto the sheet which is formed from the insoluble pulp, such that a resulting sheet having a tobacco extract content of about 41 percent (on a dry weight basis) is provided. The sheet so provided is dried to a moisture level of about 12 to about 13 percent.

EXAMPLE 5

A reconstituted tobacco material is manufactured essentially as described in Example 1 and with reference to FIG. 3.

Insoluble tobacco pulp is provided as described in Example 1. The aqueous tobacco extract is mixed with the further tobacco extract. The resulting extract is concentrated to about 24 percent tobacco extractables, and exhibits a pH of about 6.56. The liquid extract is heated to about 130° F. The resulting aqueous extract then is contacted with a concentrated aqueous solution of ammonium hydroxide to provide the liquid extract at a pH of about 7.0. Then, about 30 parts diammonium hydrogen orthophosphate in about 70 parts water is added to the aqueous extract so as to add about 0.0136 lb. diammonium phosphate per lb. of tobacco extract. The aqueous extract so treated exhibits a pH of about 7.12 and is maintained at about 130° F. for a short period of time. The treated liquid extract is about 24.2 percent tobacco extract and about 75.8 percent water.

The resulting liquid extract then is sprayed onto the sheet which is formed from the insoluble tobacco pulp, such that a resulting sheet having a tobacco extract content of about 41 percent (on a dry weight basis) is provided. The sheet so provided is dried to a moisture level of about 12 to about 13 percent.

EXAMPLE 6

A reconstituted tobacco material is manufactured as described in Example 1 and with reference to FIG. 3.

Insoluble tobacco pulp is provided as described in Example 1. The aqueous extract is concentrated to a soluble solids content of about 24 percent using wiped film evaporator, and then the aqueous extract is heated to about 200° F. for about 10 minutes in order to concentrate the aqueous extract to a soluble solids content of about 28 percent. The aqueous tobacco extract is transferred to another vessel and cools to about 180° F., at which time the aqueous extract is mixed with the further tobacco extract, which is at ambient temperature. The resulting aqueous tobacco extract is concentrated to about 24 percent tobacco extractables using a wiped film evaporator, and exhibits a pH of about 6.4. The resulting aqueous extract, which is maintained at about 130° F., then is contacted with about 30 parts diammonium hydrogen orthophosphate in about 70 parts water so as to add about 0.0326 lb. diammonium hydrogen orthophosphate per lb. of tobacco extract. The aqueous extract so treated exhibits a pH of about 6.2. The treated liquid extract is about 25 percent tobacco extract and about 75 percent water.

The resulting liquid extract then is sprayed onto the sheet which is formed from the insoluble pulp, such that a resulting sheet having a tobacco extract content of about 36 percent (on a dry weight basis) is provided. The sheet so provided is dried to a moisture level of about 12 to about 13 percent.

EXAMPLE 7

A reconstituted tobacco material is manufactured as described in Example 1 and with reference to FIG. 3.

Insoluble tobacco pulp is provided as described in Example 1. The aqueous extract is concentrated to a soluble solids content of about 38 percent using a wiped film evaporator, and then the aqueous extract is heated to about 200° F. for about 10 minutes. The aqueous tobacco extract is transferred to another vessel and cools to about 180° F., at which time the aqueous extract is mixed with a further tobacco extract, which is at ambient temperature. The further tobacco extract is provided as described in Example 1, except that the condensed liquid extract is concentrated using a reverse osmosis unit available as Sepratech from Separation Technology, Inc. equipped with Desal-3LP membranes from Desalination Systems, Inc. The resulting concentrated liquid extract has a soluble solids content of about 5 to about 7 percent. The resulting aqueous tobacco extract (i.e., the mixture resulting from the combination of the aqueous extract with the further extract) includes about 24 percent tobacco extractables, and exhibits a pH of about 7.4. The resulting aqueous extract, which is maintained at about 130° F., then is contacted with about 30 parts diammonium hydrogen orthophosphate in about 70 parts water so as to add about 0.0326 lb. diammonium hydrogen orthophosphate per lb. of tobacco extract. The aqueous extract so treated exhibits a pH of about 6.8. The treated liquid extract is about 25 percent tobacco extract and about 75 percent water.

The resulting liquid extract then is sprayed onto the sheet which is formed from the insoluble pulp, such that a resulting sheet having a tobacco extract content of about 41 percent (on a dry weight basis) is provided. The sheet so provided is dried to a moisture level of about 12 to about 13 percent.

EXAMPLE 8

A reconstituted tobacco material is manufactured essentially as described in Example 1 and generally with reference to FIG. 3.

Insoluble tobacco pulp is provided as described in Example 1. The aqueous tobacco extract is mixed with a further tobacco extract. The further tobacco extract is provided in the manner described in Example 7. The resulting extract is concentrated to about 26 percent tobacco extractables, and exhibits a pH of about 7.7. The resulting aqueous extract is provided at about 130° F. The resulting aqueous extract then is contacted with a solution of about 30 parts diammonium hydrogen orthophosphate in about 70 parts water so as to add about 0.0136 lb. diammonium hydrogen orthophosphate per lb. of dissolved tobacco solids. The aqueous extract so treated exhibits a pH of about 7.6.

The resulting liquid extract then is sprayed onto the sheet which is formed from the insoluble pulp, such that a resulting sheet having a tobacco extract content of about 40 percent (on a dry weight basis) is provided. The sheet so provided is dried to a moisture level of about 12 to about 13 percent.

EXAMPLE 9

A reconstituted tobacco material is manufactured essentially as described in Example 1 and generally with reference to FIG. 3.

Insoluble tobacco pulp extract which has been heated at ambient pressure to about 200° F. for about 10 minutes is mixed with a further tobacco extract which is at ambient temperature. The further tobacco extract is provided in the manner described in Example 7. The resulting extract is concentrated to about 28 percent tobacco extractables, and exhibits a pH of about 6.4. The resulting aqueous extract then is contacted with a solution of about 30 parts diammonium hydrogen orthophosphate in about 70 parts water so as to add about 0.0326 lb. diammonium hydrogen orthophosphate per lb. of dissolved tobacco solids. The aqueous extract so treated exhibits a pH of about 6.2.

The resulting liquid extract then is sprayed onto the sheet which is formed from the insoluble pulp, such that a resulting sheet having a tobacco extract content of about 40 percent (on a dry weight basis) is provided. The sheet so provided is dried to a moisture level of about 12 to about 13 percent.

EXAMPLE 10

A reconstituted tobacco material is manufactured essentially as described in Example 1.

The insoluble pulp from a blend of various types of tobaccos as described in Example 1.

The aqueous extract is provided by extracting a blend of various types of tobaccos in dust form with water. The tobacco dust is composed of a blend of tobacco types and is collected from a cigarette making machine. In particular, about 1 part tobacco material are contacted with about 6 parts tap water at 135° in an agitated tank. The resulting mixture is centrifuged to provide an aqueous tobacco extract and a water insoluble portion. The aqueous tobacco extract is spray dried using techniques essentially as described in U.S. patent application Ser. No. 484,587, filed Feb. 23, 1990, now U.S. Pat. No. 5,031,646 to provide a tobacco extract in powder form.

Into a Parr Reactor Model No. 4522 equipped with a temperature control unit available as Parr No. 4842-PID from the Parr Instrument Co. and a mechanical stirrer is charged about 28 parts spray dried extract, about 8 parts glutamine and about 64 parts of the aqueous further tobacco extract described in Example 1. The resulting mixture is stirred to provide a homogeneous solution. The pressure vessel is sealed, and the mixture is subjected to a maximum temperature of about 180° C. for about 1 hour at a pressure of about 400 psig. Then, the mixture within the pressure vessel is cooled to room temperature, the vessel is depressurized, and the resulting liquid tobacco composition is removed from the vessel. The liquid tobacco composition has a soluble solids content of about 40 percent. Then, about 11 parts levulinic acid is combined with the tobacco composition.

The liquid tobacco composition is sprayed onto the sheet which is formed from the insoluble pulp, such that the resulting sheet has a pulp content of about 50 percent and a tobacco composition content of about 50 percent (on a dry weight basis). The resulting sheet is dried to a moisture content of about 12 to about 13 percent.

What is claimed is:

1. A process for providing a reconstituted tobacco material, the process comprising the steps of:

(a) extracting components from tobacco material using a solvent having an aqueous character thereby providing (i) an aqueous tobacco extract and (ii) a tobacco portion insoluble in the solvent;

(b) separating at least a portion of the aqueous tobacco extract from the insoluble tobacco portion;

(c) forming the insoluble tobacco portion into a predetermined shape;

(d) providing a further tobacco extract by treating a tobacco material under extraction conditions with ammonia;

(e) contacting the further tobacco extract with the aqueous tobacco extract of step (b) thereby providing a resulting aqueous tobacco extract; and then (f) contacting the insoluble tobacco portion of step (c) with the resulting aqueous extract of step (e) to provide a reconstituted tobacco material.

2. The process of claim 1 whereby the insoluble tobacco portion is formed into a sheet-like shape.

3. The process of claim 1 or 2 whereby the reconstituted tobacco material provided in step (f) is dried to a moisture level of about 10 to about 15 weight percent.

4. The process of claim 1 whereby levulinic acid is contacted with the resulting aqueous tobacco extract prior to step (f) but after step (e).

5. The process of claim 1 whereby the resulting aqueous tobacco extract is subjected to heat treatment prior to step (f).

6. The process of claim 1 whereby the extraction conditions of step (d) further include contacting the tobacco material with steam.

7. The process of claim 1 whereby a water soluble phosphate salt is contacted with the resulting aqueous tobacco extract prior to step (f).

8. The process of claim 4 whereby a water soluble phosphate salt is contacted with the resulting aqueous tobacco extract, and then the resulting aqueous tobacco extract is contacted with levulinic acid.

9. The process of claim 5 whereby the further tobacco extract is a liquid tobacco extract, and such extract has at least a portion of present therein removed therefrom prior to step (e).

10. The process of claim 1 whereby the resulting aqueous extract is subjected to heat treatment at above ambient pressure in a pressure controlled environment at a temperature above about 100° C.

11. The process of claim 1 whereby the aqueous tobacco extract provided in step (b) is spray dried.

12. The process of claim 1 whereby the aqueous tobacco extract provided in step (b) is subjected to heat treatment to about 180° F. to about 250° F. at about ambient pressure.

13. The process of claim 1, 2, 7 or 8 whereby sufficient phosphate salt is provided within the resulting aqueous tobacco extract so as to provide a reconstituted tobacco material having a phosphate-content of about 1 to about 2.5 percent, on a dry weight basis.

14. The process of claim 1 or 2 whereby greater than about 4 parts of the tobacco extract of step (b) is contacted with each part of the further tobacco extract of step (d), on a dry weight basis.

15. The process of claim 1 or 2 whereby about 6 to about 10 parts of the tobacco extract of step (b) is contacted with each part of the further tobacco extract of step (d), on a dry weight basis.

16. The process of claim 1 or 2 whereby the resulting aqueous tobacco extract provided in step (e) has a soluble solids content of about 20 to about 35 weight percent.

17. The process of claim 1 or 2 whereby the further tobacco extract is an aqueous tobacco extract which includes water, about 4 to about 8 percent tobacco extract and about 0.1 to about 2 percent ammonia, based on the weight of the aqueous tobacco extract.

18. The process of claim 1 or 2 whereby about 0.5 to about 1.5 parts of tobacco extract of the resulting aqueous tobacco extract is contacted with the insoluble tobacco portion of step (c), per weight part of tobacco extract separated from the insoluble tobacco portion in step (b).

19. The process of claim 1 or 2 whereby the insoluble tobacco portion has a moisture content of about 30 to about 80 weight percent prior to contact thereof with the resulting aqueous extract in step (f).

20. The process of claim 1 or 2 whereby the insoluble tobacco portion is contacted with an additive prior to step (c).

21. The process of claim 20 whereby an amount of additive not exceeding about 15 percent, based on the dry weight of the insoluble tobacco portion, is combined with the insoluble tobacco portion.

22. The process of claim 1 or 2 whereby the further tobacco extract is contacted with phosphoric acid prior to step (e).

23. The process of claim 1 or 2 whereby the further tobacco extract is an aqueous tobacco extract, and water of the aqueous tobacco extract is removed therefrom to provide a concentrated aqueous tobacco extract.

24. The process of claim 23 whereby the further aqueous tobacco extract includes ammonia, and at least a portion of ammonia is removed therefrom as the concentrated aqueous tobacco extract is provided.

25. The process of claim 1 or 2 whereby the ammonia has a form of anhydrous ammonia.

26. The process of claim 1 or 2 whereby the ammonia has a form of ammonium hydroxide.

27. The process of claim 1 or 2 whereby the further tobacco extract is an aqueous tobacco extract, and water of the aqueous tobacco extract and essentially all ammonia present in the aqueous tobacco extract are removed therefrom to provide a concentrated aqueous tobacco extract.

28. The process of claim 1 whereby an organic acid is provided within the resulting aqueous tobacco extract.

29. The process of claim 28 whereby the organic acid has the form of an organic acid salt.

30. The process of claim 28 or 29 whereby sufficient organic acid is provided within the resulting aqueous tobacco extract so as to provide a reconstituted tobacco material having a content of anionic moiety of organic acid of greater than about 1 percent, on a dry weight basis.

31. The process of claim 28 or 29 whereby sufficient organic acid is provided within the resulting aqueous tobacco extract so as to provide a reconstituted tobacco material having a content of anionic moiety of organic acid of greater than about 5 percent, on a dry weight basis.

* * * * *